US008710347B2

(12) United States Patent
Harada

(10) Patent No.: US 8,710,347 B2
(45) Date of Patent: Apr. 29, 2014

(54) PERFORMANCE APPARATUS AND ELECTRONIC MUSICAL INSTRUMENT

(75) Inventor: Eiichi Harada, Hamura (JP)

(73) Assignee: Casio Computer Co., Ltd., Tokyo (JP)

( * ) Notice: Subject to any disclaimer, the term of this patent is extended or adjusted under 35 U.S.C. 154(b) by 328 days.

(21) Appl. No.: 13/155,535

(22) Filed: Jun. 8, 2011

(65) Prior Publication Data

US 2011/0303076 A1 Dec. 15, 2011

(30) Foreign Application Priority Data

Jun. 15, 2010 (JP) ..... 2010-136063

(51) Int. Cl.
*G10H 3/00* (2006.01)

(52) U.S. Cl.
USPC ..... 84/723; 84/600

(58) Field of Classification Search
USPC ..... 84/723, 742, 600, 737
See application file for complete search history.

(56) References Cited

U.S. PATENT DOCUMENTS

| | | | | |
|---|---|---|---|---|
| 5,058,480 | A | 10/1991 | Suzuki et al. | |
| 5,177,311 | A | 1/1993 | Suzuki et al. | |
| 6,867,361 | B2 * | 3/2005 | Nishitani et al. | 84/658 |
| 6,897,779 | B2 * | 5/2005 | Nishitani et al. | 340/573.1 |
| 7,135,637 | B2 * | 11/2006 | Nishitani et al. | 84/723 |
| 7,161,079 | B2 * | 1/2007 | Nishitani et al. | 84/612 |
| 7,183,480 | B2 * | 2/2007 | Nishitani et al. | 84/615 |
| 7,528,318 | B2 * | 5/2009 | Nishitani et al. | 84/735 |
| 7,781,666 | B2 * | 8/2010 | Nishitani et al. | 84/723 |
| 8,106,283 | B2 * | 1/2012 | Nishitani et al. | 84/612 |

FOREIGN PATENT DOCUMENTS

| | | | |
|---|---|---|---|
| JP | 2663503 | B2 | 10/1997 |
| JP | 2004-219947 | A | 8/2004 |
| JP | 2007-034002 | A | 2/2007 |
| JP | 2007-149218 | A | 6/2007 |
| JP | 2007/256736 | A | 10/2007 |
| JP | 2009-282203 | A | 12/2009 |
| JP | 2010-015073 | A | 1/2010 |

OTHER PUBLICATIONS

Chinese Office Action dated Mar. 31, 2012 (and English translation thereof) in counterpart Chinese Application No. 201110160565.2.
Japanese Office Action dated May 29, 2012 (and English translation thereof) in counterpart Japanese Application No. 2010-136063.

* cited by examiner

*Primary Examiner* — Jeffrey Donels
(74) *Attorney, Agent, or Firm* — Holtz, Holtz, Goodman & Chick, PC

(57) ABSTRACT

Based on acceleration-sensor values from a three-dimensional acceleration sensor 23, CPU 21 of a performance apparatus 11 determines a timing at which a musical tone is generated. Further, based on the acceleration-sensor values of the acceleration sensor 23 given at a predetermined timing, for example, at a time when a player starts swinging of the performance apparatus 11, a roll angle of the performance apparatus 11 rotating about an axis in its longitudinal direction is calculated. A timbre of musical tones to be generated is determined based on the calculated roll angle.

14 Claims, 14 Drawing Sheets

900

| $0 \leq \phi < 90$ | $90 \leq \phi < 180$ | $180 \leq \phi < 270$ | $270 \leq \phi < 360$ |
|---|---|---|---|
| PIANO | GUITAR | TRUMPET | TOM |

PERFORMANCE APPARATUS AND ELECTRONIC MUSICAL INSTRUMENT

CROSS REFERENCE TO RELATED APPLICATIONS

The present application is based upon and claims the benefit of priority from the prior Japanese Patent Application No. 2010-136063, file Jun. 15, 2010, and the entire contents of which are incorporated herein by reference.

BACKGROUND OF THE INVENTION

1. Field of the Invention

The present invention relates to a performance apparatus and an electronic musical instrument, which generate musical tones, when gripped and swung by a player with his or her hand.

2. Description of the Related Art

An electronic musical instrument has been proposed, which has an elongated member of a stick type with a sensor provided thereon, and generates musical tones when the sensor detects the motion of the elongated member. The elongated member of a stick type has a shape of a drumstick, and the electronic musical instrument is constructed so as to generate musical tones as if percussion instruments generate sounds in response to player's motion of striking drums and/or Japanese drums.

For instance, U.S. Pat. No. 5,058,480 discloses a performance apparatus, which is provided with an acceleration sensor on its stick-type member, and generates a musical tone when a certain period of time has lapsed after an output (acceleration-sensor value) from the acceleration sensor reaches a predetermined threshold value.

The performance apparatus disclosed in U.S. Pat. No. 5,058,480 simply controls generation of musical tones based on the acceleration-sensor value of the stick-type member and therefore has a drawback that it is hard to change musical tones as a player desires.

Meanwhile, Japanese Patent No. 2007-256736 A discloses an apparatus for generating musical tones of plural timbres, which apparatus is provided with a geomagnetic sensor in addition to an acceleration sensor, and detects an orientation of a stick-type member based on a sensor value from the geomagnetic sensor, selecting based on the detected orientation one from among plural timbres of musical tones to be generated.

SUMMARY OF THE INVENTION

The present invention has an object to provide a performance apparatus and an electronic musical instrument, which are able to generate a musical tone at a timing desired by a player, using a single sensor, and to change a musical-tone composing element as the player desires.

According to one aspect of the invention, there is provided a performance apparatus to be used with a musical-tone generating device for generating musical tones, which apparatus comprises a holding member extending in a longitudinal direction to be held by a player with his or her hand, an acceleration sensor provided in the holding member, for obtaining acceleration-sensor values along three axial directions, and controlling means for giving the musical-tone generating device an instruction of generating a musical tone, wherein the controlling means comprises sound-generation instructing means for giving the musical-tone generating device an instruction of generating a musical tone at a timing specified based on the acceleration-sensor values obtained by the acceleration sensor, angle calculating means for calculating based on the acceleration-sensor values obtained by the acceleration sensor at a certain timing an angle of the holding member rotating about one of the three axes of the acceleration sensor, and musical-tone composing element deciding means for deciding a musical-tone composing element of a musical tone to be generated, based on the angle calculated by the angle calculating means.

According to another aspect of the invention, there is provided an electronic musical instrument, which comprises a musical instrument unit having a musical-tone generating device for generating musical tones and a performance apparatus having a holding member extending in a longitudinal direction to be held by a player with his or her hand; an acceleration sensor provided in the holding member for obtaining acceleration-sensor values along three axial directions; and controlling means for giving the musical-tone generating device an instruction of generating a musical tone, wherein the controlling means comprises sound-generation instructing means for giving the musical-tone generating device an instruction of generating a musical tone at a timing specified based on the acceleration-sensor values obtained by the acceleration sensor, angle calculating means for calculating based on the acceleration-sensor values obtained at a certain timing an angle of the holding member rotating about one of the three axes of the acceleration sensor, and musical-tone composing element deciding means for deciding a musical-tone composing element of a musical tone to be generated, based on the angle calculated by the angle calculating means, wherein both the musical instrument unit and the performance apparatus comprise communication means for exchanging data with each other.

BRIEF DESCRIPTION THE DRAWINGS

Figures 9A, 9B:
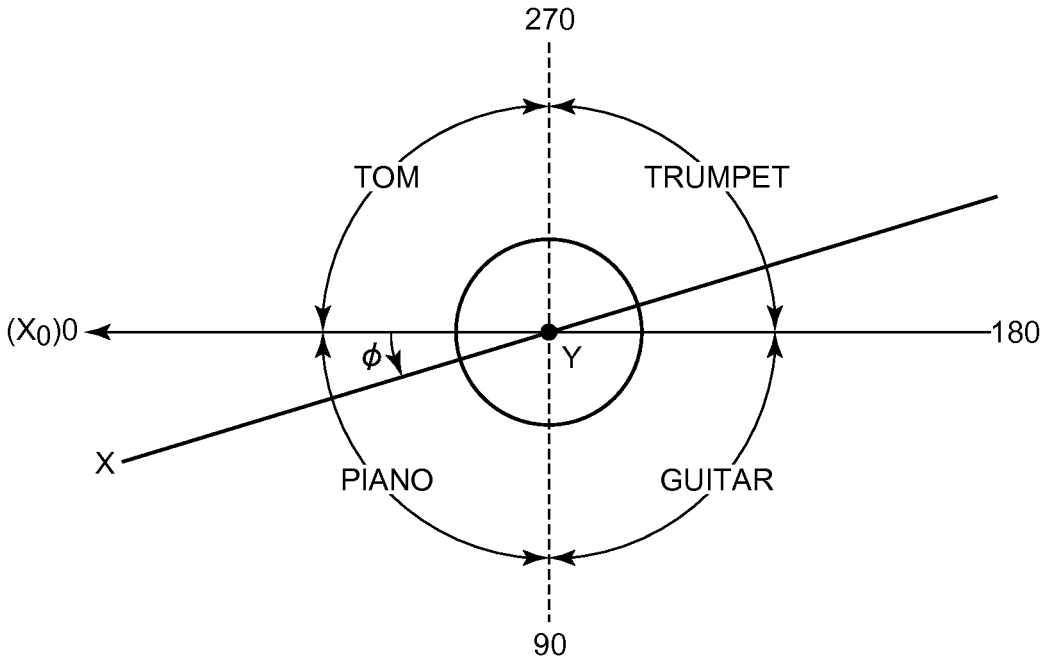

FIG. 9*a* is a view showing a relationship between roll angles and timbres of musical tones.

FIG. 9*b* is a view showing an example of a timbre table, which associates ranges of the roll angles with timbres of musical tones.

Figure 10:
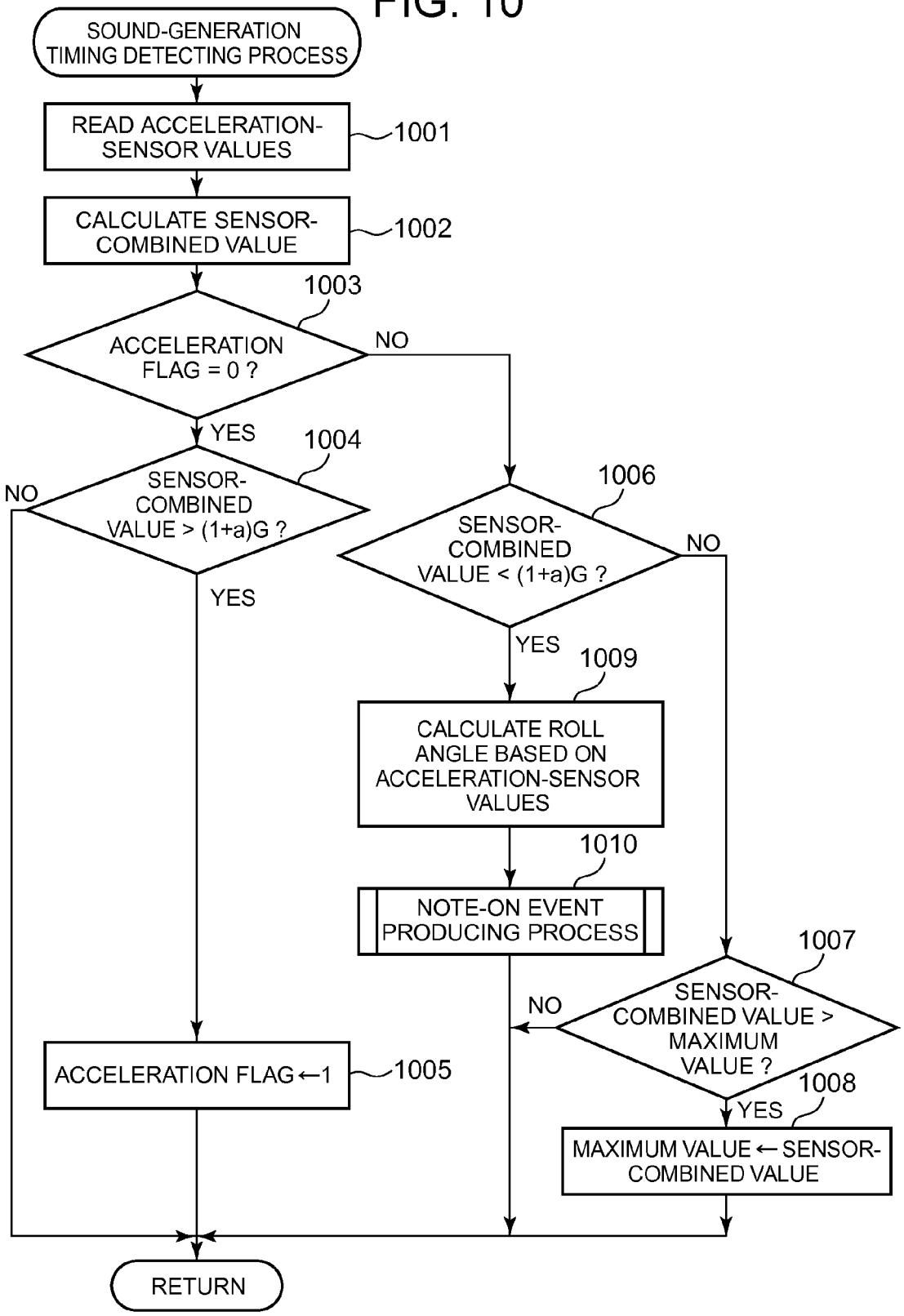

FIG. 10 is a flow chart of an example of the sound-generation timing detecting process performed in the second embodiment of the invention.

Figure 11:
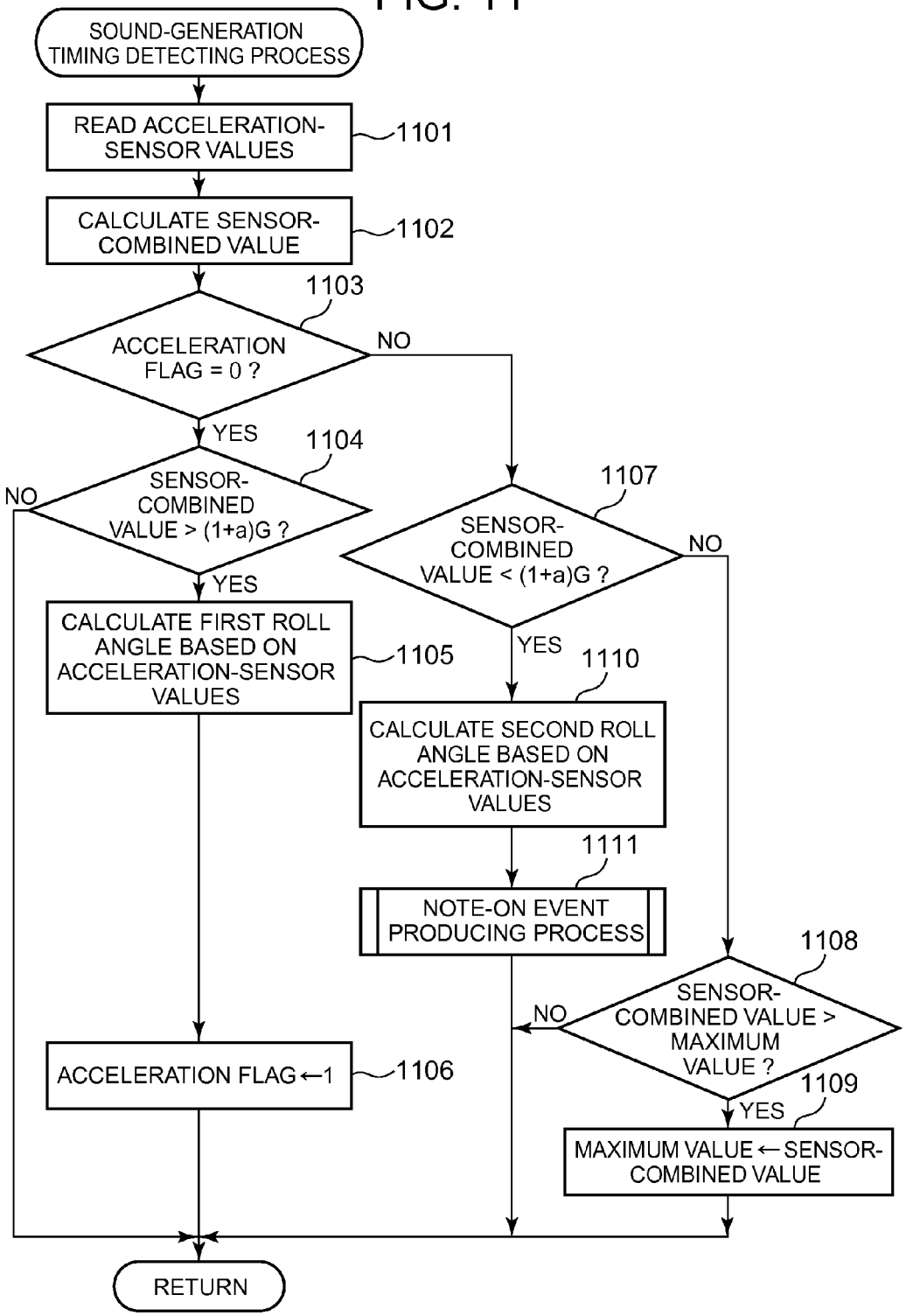

FIG. 11 is a flow chart of an example of the sound-generation timing detecting process performed in the third embodiment of the invention.

Figure 12:
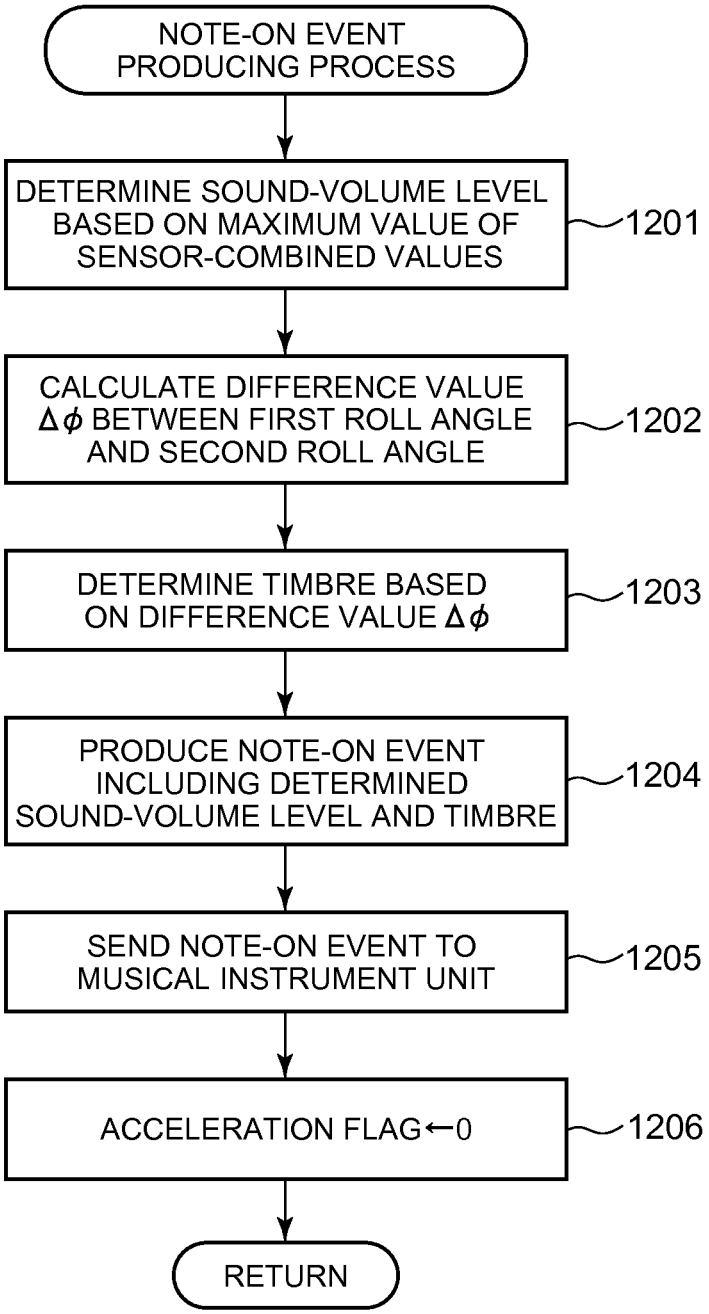

FIG. 12 is a flowchart of an example of the note-on event producing process performed in the third embodiment of the invention.

Figure 13:
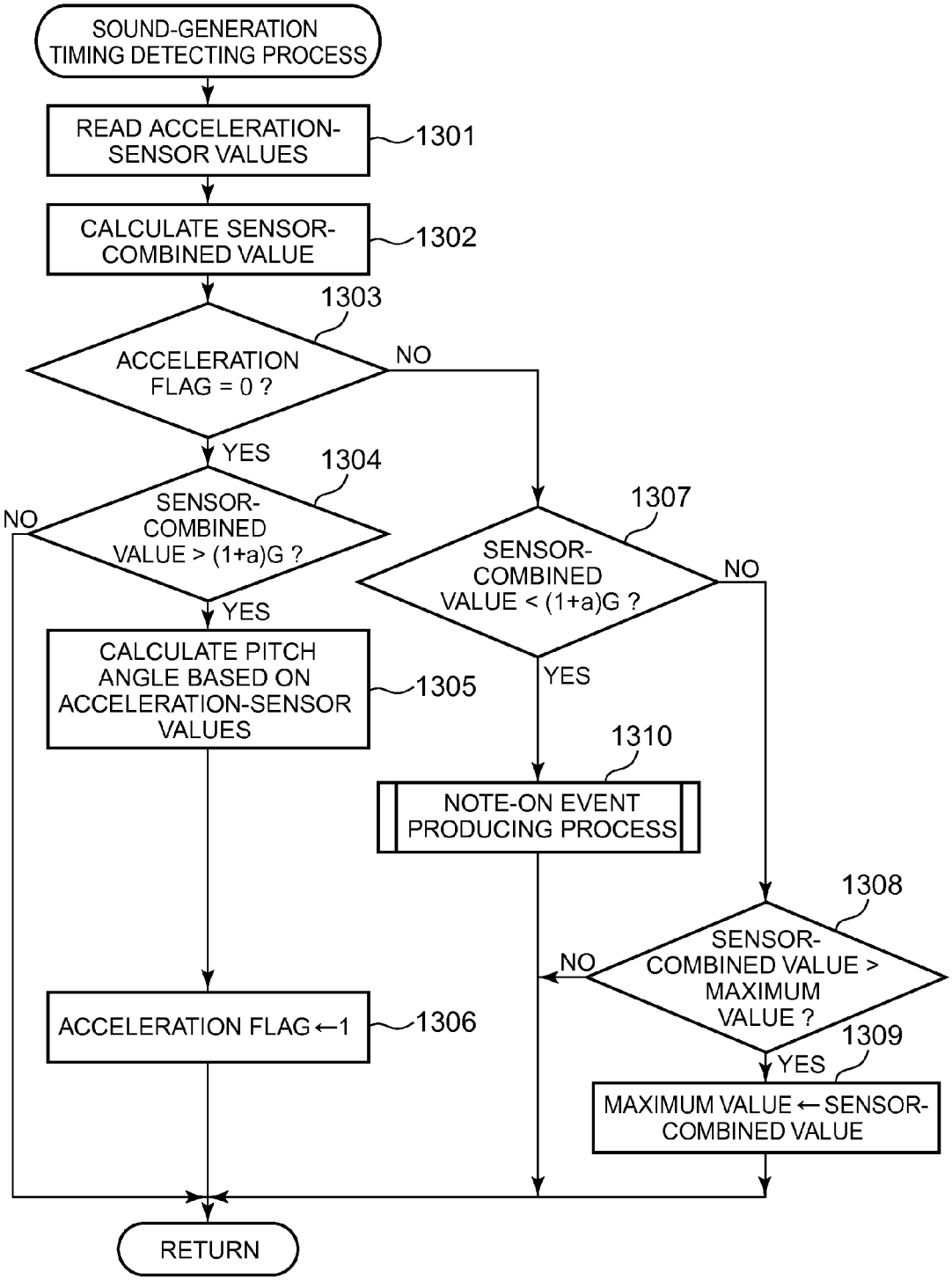

FIG. 13 is a flow chart of an example of the sound-generation timing detecting process performed in the fourth embodiment of the invention.

Figure 14:
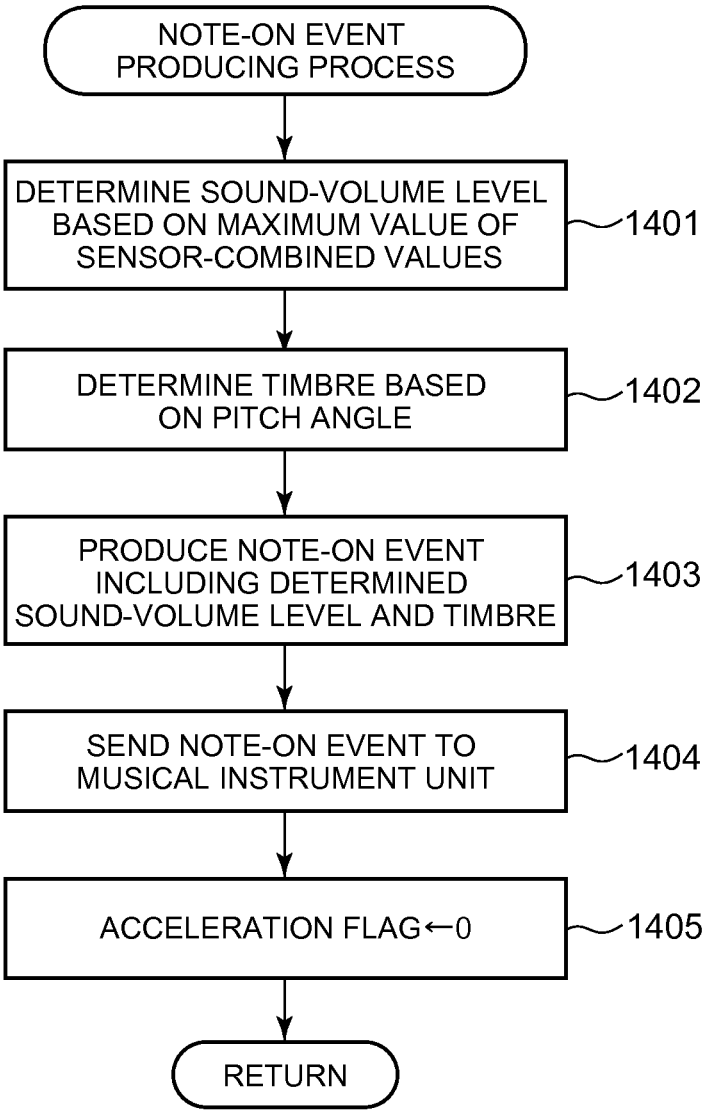

FIG. 14 is a flowchart of an example of the note-on event producing process performed in the fourth embodiment of the invention.

DETAILED DESCRIPTION OF THE PREFERRED EMBODIMENTS

Figure 1:
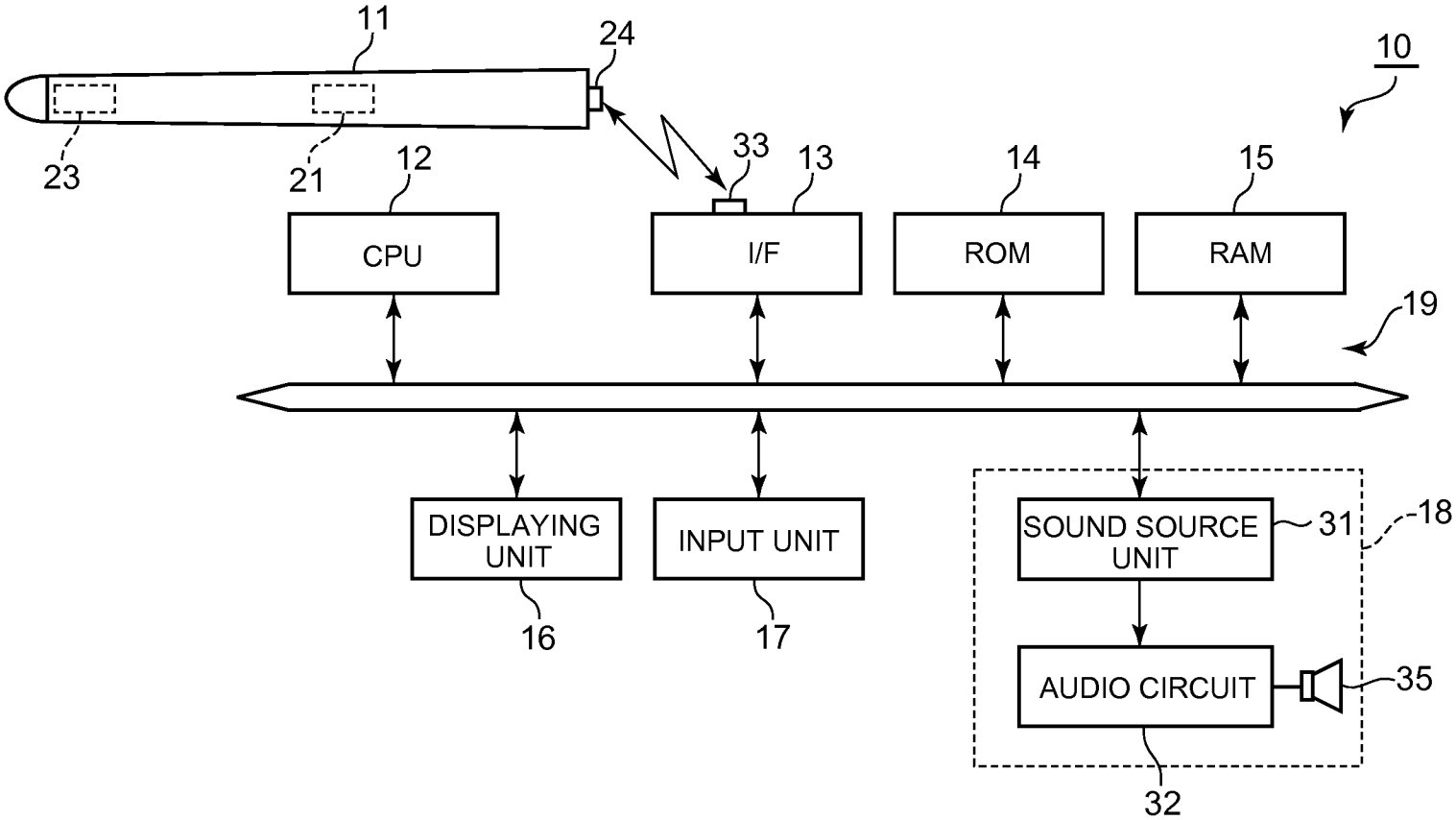
FIG. 1 is a block diagram showing a configuration of an electronic musical instrument according the first embodiment of the invention.

Now, embodiments of the present invention will be described with reference to the accompanying drawings. FIG. 1 is a block diagram showing a configuration of an electronic musical instrument according the first embodiment of the invention. As shown in FIG. 1, the electronic musical instrument 10 according the first embodiment is provided with a stick-type performance apparatus 11, which extends in its longitudinal direction. The performance apparatus 11 is held or gripped by a player with his or her hand to swing it. Further, the electronic musical instrument 10 is provided with a musical instrument unit 19, which generates musical tones. The musical instrument unit 19 comprises CPU 12, an interface (I/F) 13, ROM 14, RAM 15, a displaying unit 16, an input unit 17 and a sound system 18. As will be described later, the performance apparatus 11 is provided with an acceleration sensor 23 on the side opposite to a base of the elongated performance apparatus 11. The player grips the base to swing the elongated performance apparatus 11.

The I/F 13 of the musical instrument unit 19 serves to receive data (for instance, a note-on event) from the performance apparatus 11 to store the received data in RAM 15 and to give notice of receipt of such data to CPU 12. In the present embodiment, the performance apparatus 11 is provided with an infrared communication device 24 at the edge of the base of the performance apparatus 11 and the I/F 13 of the musical instrument unit 19 is also provided with an infrared communication device 33. Therefore, the infrared communication device 33 of I/F 13 receives infrared light generated by the infrared communication device 24 of the performance device 11, whereby the musical instrument unit 19 can receive data from the performance apparatus 11.

CPU 12 serves to control whole operation of the electronic musical instrument 10. In particular, CPU 12 serves to perform various processes including a controlling operation of the musical instrument unit 19, a detecting operation of a manipulated state of key switches (not shown) in the input unit 17 and a generating operation of musical tones based on note-on events received through I/F 13.

ROM 14 stores various programs for controlling the whole operation the electronic musical instrument 10, controlling the operation of the musical instrument unit 19, detecting the operated state of the key switches (not shown) in the input unit 17 and generating musical tones based on note-on events received through I/F 13. ROM 14 has a waveform-data area for storing waveform data of various timbres, including waveform data of wind instruments such as flutes, saxes and trumpets, keyboard instruments such as pianos, string instruments such as guitars, and percussion instruments such as bass drums, high-hats, snare drums and cymbals.

RAM 15 serves to store programs read from ROM 14, and data and parameters generated during the course of process. The data generated in the process includes the manipulated state of the switches in the input unit 17, sensor values received through I/F 13 and generating states of musical tones (sound generation graph).

The displaying unit 16 has a liquid crystal displaying device (not shown) and is able to display a selected timbre and contents of a timbre table, wherein the timbre table associates ranges of angles with timbres of musical tones, respectively. The input unit 17 has the switches (not shown).

The sound system 18 comprises a sound source unit 31, audio circuit 32 and a speaker 35. In accordance with an instruction from CPU 12, the sound source unit 31 reads waveform data from the waveform-data area of ROM 14 to generate and outputs musical-tone data. The audio circuit 32 converts the musical-tone data output from the sound source unit 31 into an analog signal and amplifies the analog signal to output the amplified signal from the speaker 35, whereby musical tones are output from the speaker 35.

Figure 2:
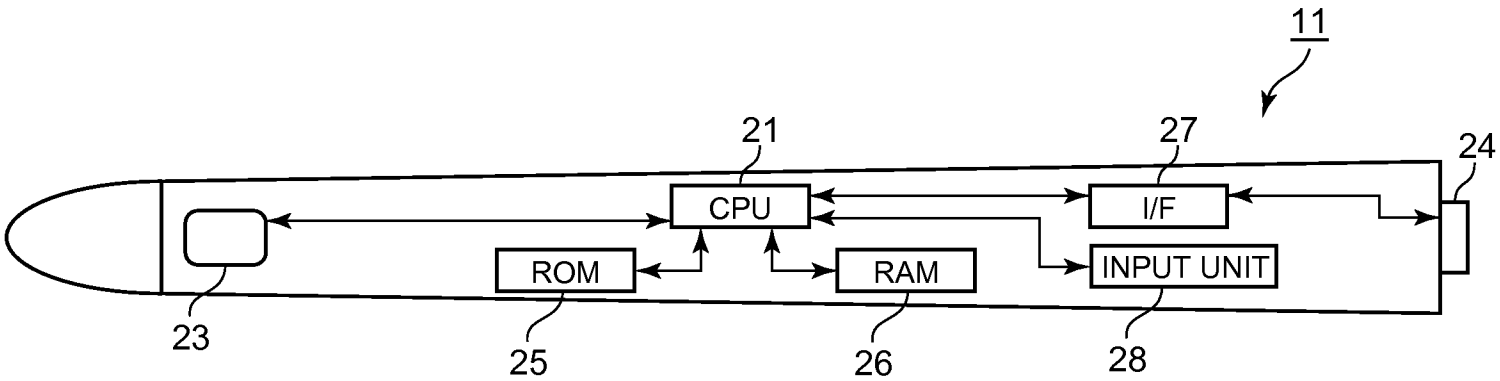
FIG. 2 is a block diagram showing a configuration of a performance apparatus in the first embodiment of the invention.

FIG. 2 is a block diagram of a configuration of the performance apparatus 11 in the first embodiment of the invention. As shown in FIG. 2, the performance apparatus 11 is provided with the acceleration sensor 23 on the portion opposite to the base where the player holds or grips with his or her hand. The acceleration sensor 23 is a 3-dimensional sensor of a capacitance type and/or a piezoresistive type, which is able to output acceleration-sensor values representing accelerations, which are yielded in three axial directions such as in X, Y and Z-direction, respectively, when the performance apparatus 11 is swung by the player.

Figure 3:
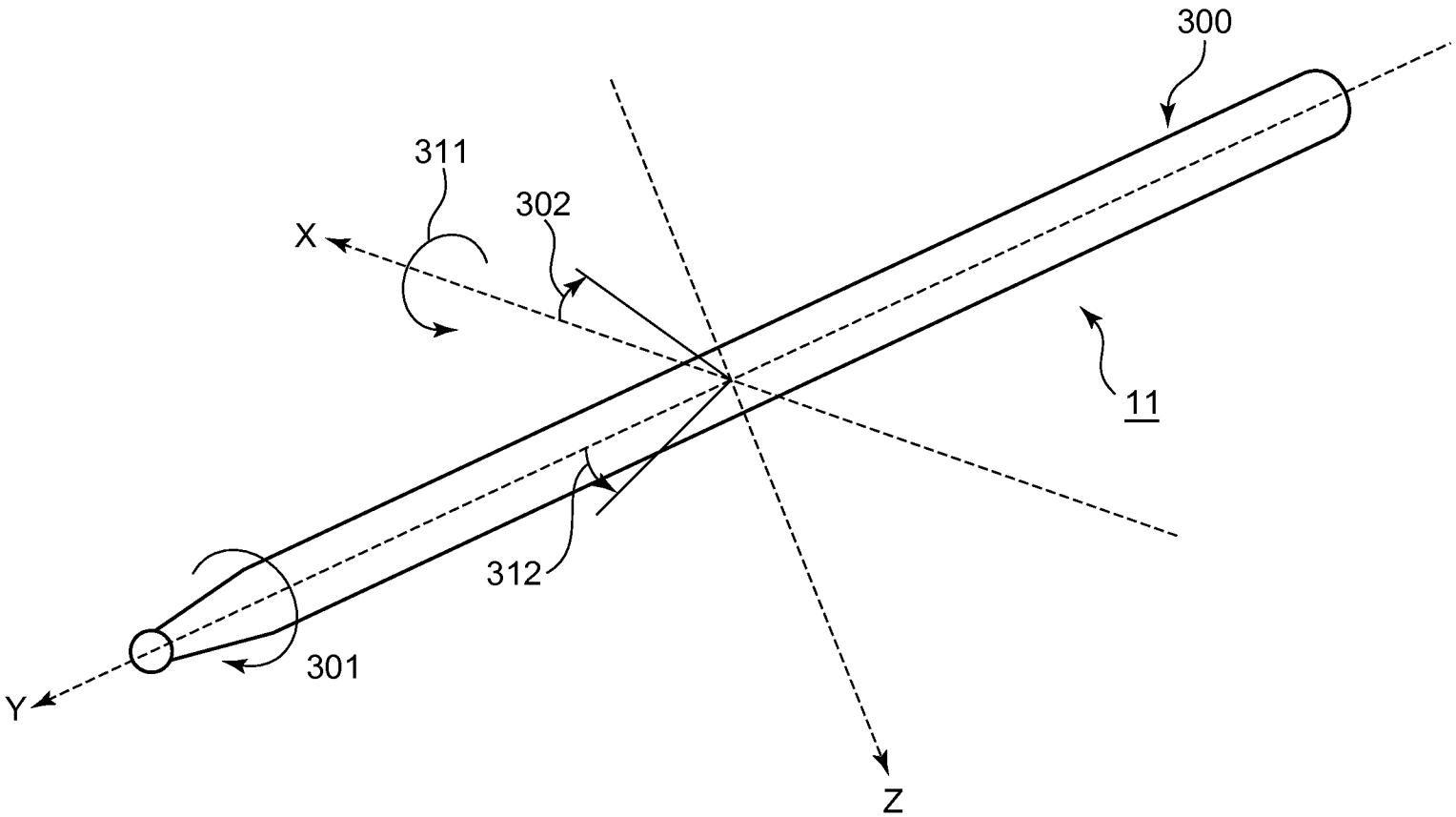
FIG. 3 is an external view of the elongated performance apparatus according to the first embodiment.

When the player actually plays or strikes the heads of the drums, he or she grips the one end (base portion) of the drumstick with his or her hand and rotates the drumstick with his or her wrist kept at the center of the rotating motion. FIG. 3 is an external view of the elongated performance apparatus according to the first embodiment. In FIG. 3, the Y-axis coincides with the axis in the longitudinal direction of the performance apparatus 11. The X-axis runs in parallel with a substrate (not shown), on which the acceleration sensor 23 is mounted, and intersects with the Y-axis at right angles. The Z-axis is perpendicular to the X-axis and the Y-axis. The acceleration sensor 23 in the first embodiment is able to obtain acceleration-sensor value components along the X-axis, Y-axis and Z-axis, respectively. CPU 21 combines the acceleration-sensor value components along the X-axis, Y-axis and Z-axis together to calculate a sensor-combined value. When the performance apparatus 11 is kept still, the sensor-combined value obtained by combining the acceleration-sensor value components along the X-axis, Y-axis and X-axis together will correspond to the gravity acceleration of "1G". Meanwhile, when the player grips with his or her hand and swings the performance apparatus 11, the sensor-combined value will be larger than "1G".

In FIG. 3, a rotation angle about the Y-axis (refer to Reference number: 301) is a rotating angle about the longitudinal axis of the elongated performance apparatus 11, which is referred to as a "roll angle" of the performance apparatus 11. When an X-Y plane is turned about the Y-axis, the roll angle measures angles of the X-Y plane to the X-axis (refer to Reference number: 302). The "roll angle" appears when the player grips the base portion (refer to Reference number: 300) of the performance apparatus 11 with his or her hand and twists his or her wrist in a clockwise or counter clockwise direction.

In FIG. 3, a rotation angle about the X-axis (refer to Reference number: 311) is a rotating angle about the axis perpendicular to the longitudinal axis of the elongated performance apparatus 11, which is referred to as a "pitch angle" of the performance apparatus 11. When the X-Y plane is turned about the X-axis, the pitch angle measures angles of the X-Y plane to the Y-axis (refer to Reference number: 312). The "pitch angle" is shown when the player grips the base portion (refer to Reference number: 300) of the performance apparatus 11 with his or her hand and swings the performance apparatus 11 upward and downward.

As shown in FIG. 2, the performance apparatus 11 comprises CPU 21, the infrared communication device 24, ROM 25, RAM 26, an interface (I/F) 27 and an input unit 28. CPU 21 performs various processes including an obtaining operation of acceleration-sensor values in the performance apparatus 11, a detecting operation of timings of sound generation of musical tones in accordance with the acceleration-sensor values, a determining operation of a timbre of musical tones in accordance with the acceleration-sensor values, a producing operation of note-on events, and an operation of controlling a sending operation of the note-on event through I/F 27 and the infrared communication device 24.

ROM 25 stores various process programs for obtaining acceleration-sensor values in the performance apparatus 11, detecting a timing of sound generation of a musical tone in accordance with the acceleration-sensor values, determining a timbre of musical tones in accordance with the acceleration-sensor values, producing note-on events, and controlling a sending operation of the note-on event through I/F 27 and the infrared communication device 24. RAM 26 stores values produced and/or obtained in the process such as an acceleration-sensor value, and tables to be described later. Data is supplied to the infrared communication device 24 through I/F 27 in accordance with an instruction from CPU 21. The input unit 28 includes switches (not shown).

Figure 4:
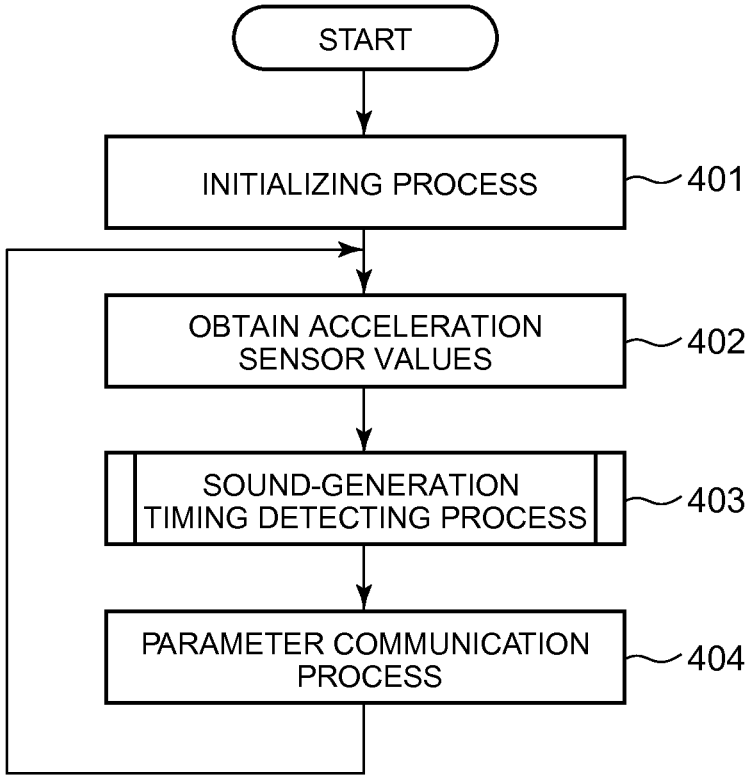
FIG. 4 is a flow chart of an example of a process performed in the performance apparatus according to the first embodiment.

FIG. 4 is a flowchart showing an example of a process performed in the performance apparatus 11 according to the first embodiment. CPU 21 of the performance apparatus 11 performs an initializing process at step 401, including a process of clearing data in RAM 26 and resetting an acceleration flag.

After performing the initializing process at step 401, CPU 21 obtains sensor values (acceleration-sensor values) of the acceleration sensor 23 and stores the obtained sensor values in RAM 26 at step 402. As described before, the acceleration sensor 23 in the present embodiment is the 3-dimensional sensor, and obtains acceleration-sensor value components in the X-axis, Y-axis and Z-axis, respectively. These acceleration-sensor value components are stored in RAM 26.

Figure 5:
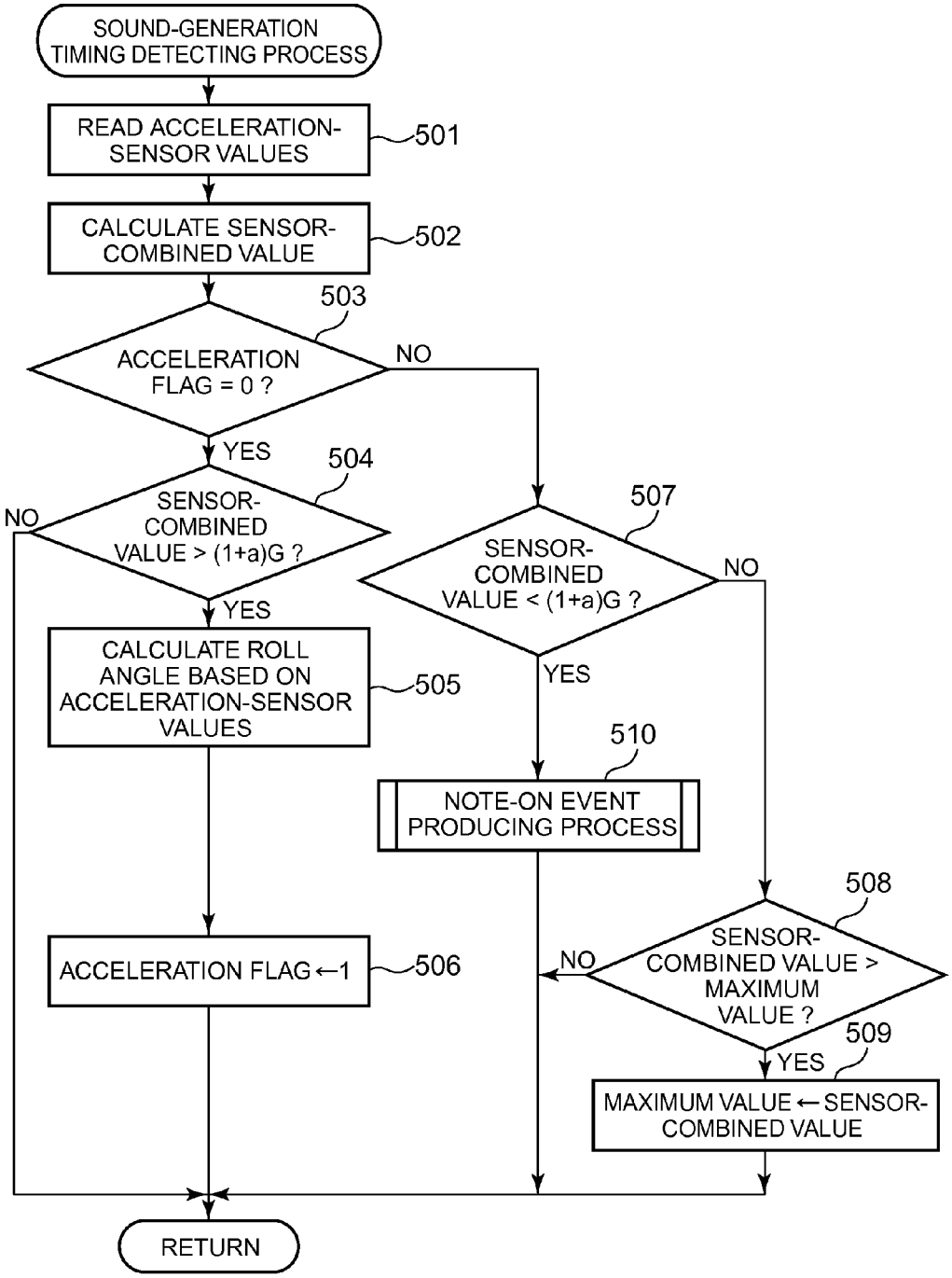
FIG. 5 is a flow chart of an example of a sound-generation timing detecting process performed in the performance apparatus in the first embodiment.

Then, CPU 21 performs a sound-generation timing detecting process at step 403. FIG. 5 is a flow chart showing an example of the sound-generation timing detecting process performed in the performance apparatus 11 according to the first embodiment. CPU 21 reads acceleration-sensor value components from RAM 26 at step 501. CPU 21 calculates a sensor-combined value from the acceleration-sensor value components along the X-axis, Y-axis and Z-axis read from RAM 26 (step 502). The sensor-combined value can be obtained, for example, by finding the square root of the sum of the squares of the acceleration-sensor value components along the X-axis, Y-axis and Z-axis.

CPU 21 judges at step 503 whether or not an acceleration flag in RAM 26 has been set to "0". When it is determined YES at step 503, CPU 21 judges at step 504 whether or not the sensor-combined value is larger than a value of (1+a) G, where "a" is a positive fine constant. For example, if "a" is "0.05", it will be judged whether or not the sensor-combined value is larger than a value of 1.05G. In the case it is determined YES at step 503, this means that the performance apparatus 11 is swung by the player and the sensor-combined value has increased to a value larger than the gravity acceleration of "1G". The value of "a" is not limited to "0.05". On the assumption that "a"=0, it is possible to judge at step 504 whether not the sensor-combine value is larger than a value corresponding to the gravity acceleration "1G".

When it is determined at step 504 that the sensor-combined value is larger than 1.05G (YES at step 504), CPU 21 calculates a roll angle based on the acceleration-sensor values at step 505. The calculated roll angle is stored in RAM 26. The acceleration-sensor value components (x, y, z) along the X-axis, Y-axis and Z-axis used in calculation of the roll angle will be substantially equivalent to (0.0.1G). The roll angle and the pitch angle will be calculated by well-known matrix operation using the acceleration-sensor values.

Thereafter, CPU 21 sets the acceleration flag in RAM 26 to "1" at step 506. When it is determined at step 504 that the sensor-combined value is not larger than the value of 1.05G (NO at step 504), then, the sound-generation timing detecting process terminates.

When it is determined at step 503 that the acceleration flag in RAM 26 has been set to "1" (NO at step 503), CPU 21 judges at step 507 whether or not the sensor-combined value is less than a value of (1+a)G. When it is determined NO at step 507, CPU 21 judges at step 508 whether or not the sensor-combined value calculated at step 502 is larger than the maximum value of the sensor-combined values stored in RAM 26. When it is determined YES at step 508, CPU 21 stores in RAM 26 such calculated sensor-combined value as the new maximum value at step 509. When it is determined NO at step 508, the sound-generation timing detecting process terminates.

When it is determined at step 507 that the sensor-combined value is less than a value of (1+a)G (YES at step 507), CPU 21 performs a note-on event producing process at step 510.

Figure 6:
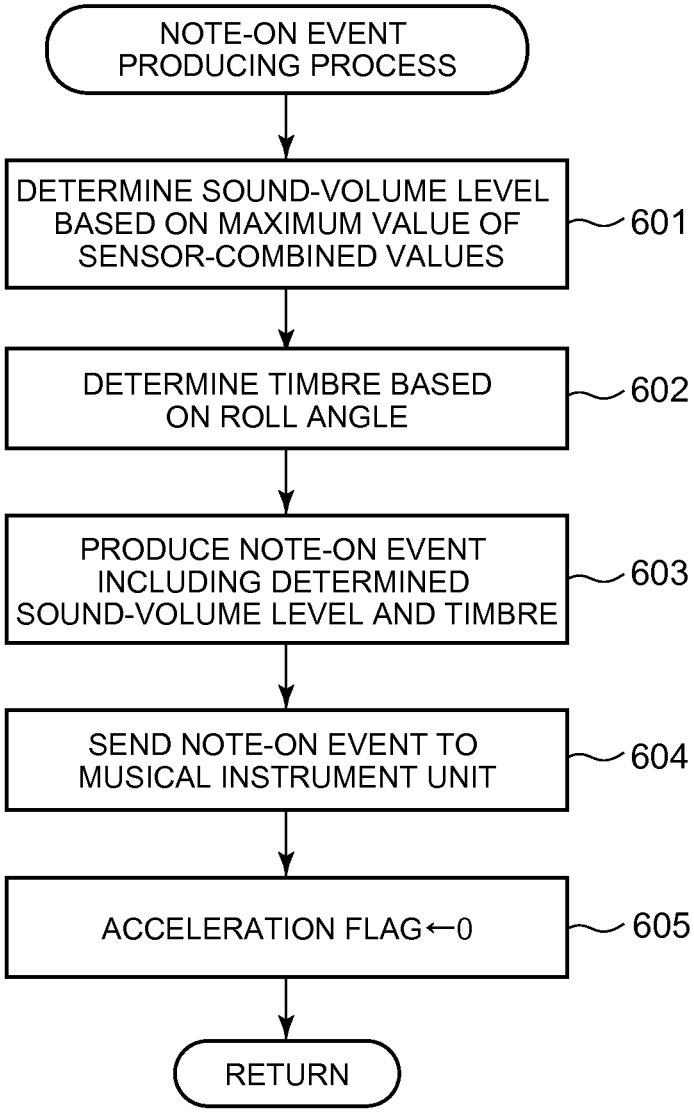
FIG. 6 is a flow chart of an example of a note-on event producing process performed in the performance apparatus according to the first embodiment.

FIG. 6 is a flow chart showing an example of the note-on event producing process performed in the performance apparatus 11 according to the present embodiment. In the note-on event producing process shown in FIG. 6, a note-on event is sent from the performance apparatus 11 to the musical instrument unit 19, and then a sound generating process (FIG. 7) is performed in the musical instrument unit 19, whereby musical tone data is generated and a musical tone is output from the speaker 35.

Figure 8:
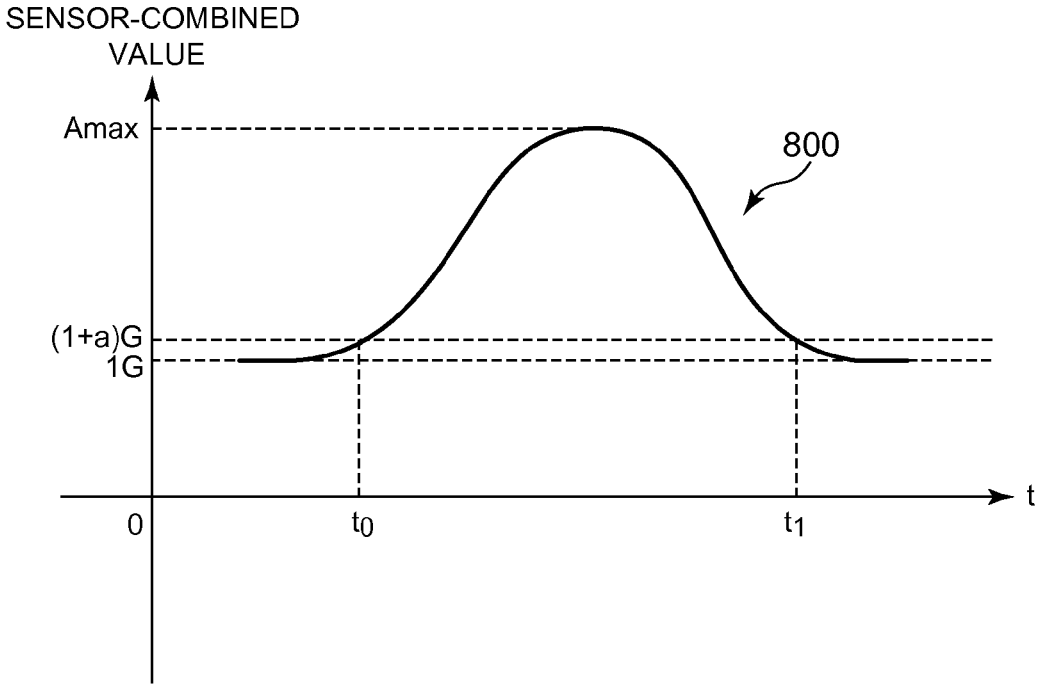
FIG. 8 is a graph that typically represents a combined value of acceleration-sensor values detected by an acceleration sensor of the performance apparatus.

Before describing the note-on event producing process, the sound-generation timing in the electronic musical instrument 10 of the present embodiment will be described. FIG. 8 is a graph that typically represents an example of a sensor-combined value representing a combined value of acceleration-sensor values detected by the acceleration sensor 23 of the performance apparatus 11. As shown by a curve 800 in FIG. 8, when the player keeps the performance apparatus 11 still, the sensor-combined value will measure a value of "1G". When the player swings the performance apparatus 11, the sensor-combined value will increase, and when the player holds the performance apparatus 11 still again after swinging it, then the sensor-combined value will return to a value of "1G".

In the present embodiment, at the time "$t_0$" when the sensor-combined value has increased larger than a value of (1+a) G, where "a" is a positive fine constant, a roll angle is calculated based on acceleration-sensor values (refer to step 505 in FIG. 5). In other words, angles are obtained, of the player's wrist twisted immediately after he or she has begun swinging the performance apparatus 11. A note-on event process to be described later is performed at the time $t_1$ when the sensor-combined value has increased larger than the value of (1+a)G, where "a" is a positive fine value, and a musical tone is generated. As shown in FIG. 6, in the note-on event producing process, CPU 21 refers to the maximum value of the sensor-combined values stored in RAM 26 to determine a sound-volume level (velocity) of a musical tone in accordance with such maximum value (step 601).

The maximum value of the sensor-combined values is denoted by Amax, and the maximum value of the sound-volume levels (velocity) is denoted by Vmax. Then, the sound-volume level Vel will be given by the following equation:

$$Vel=a\cdot A\max, \text{where if } a\cdot A\max \geq V\max, Vel=V\max, \text{and}$$
"$a$" is a positive constant.

CPU 21 determines a timbre of a musical tone to be generated based on the roll angle at 602. FIG. 9*a* is a view showing relationship between the roll angles and timbres of musical tones. FIG. 9*b* is a view showing an example of a timbre table, which associates ranges of the roll angles with timbres of musical tones. As shown in FIG. 9*a*, either one of four timbres of musical tones can be selected depending on the ranges of the roll angles Φ in the present embodiment. In FIG. 9*a*, the roll angle Φ is represented by a difference in angle between an X-Y plane and a reference plane when the X-Y plane is rotated about the Y-axis, wherein the reference plane is defined by the $X_0$-axis and the Y-axis.

In the present embodiment, the timbre table (Reference number: 900 in FIG. 9*b*), which associates the ranges of the roll angles Φ with the timbres of musical tones, is stored in RAM 26. CPU 21 refers to the timbre table 900 to obtain the timbre of a musical tone corresponding to the range, into which the calculated roll angle falls (step 505 in FIG. 5).

Thereafter, CPU 21 produces a note-on event including information representing a sound volume level (velocity), a timbre and a predetermined pitch at step 603. Regarding the pitch, a predetermined value is used. CPU 21 outputs the produced note-on event to the infrared communication device 24 through I/F 27 at step 604. Then, an infrared signal of the note-on event is sent from the infrared communication device 24. The infrared signal sent from the infrared communication device 24 is received by the infrared communication device 33 of the musical instrument unit 19. Thereafter, CPU 21 resets the acceleration flag in RAM 26 to "0" at step 605.

When the sound-generation timing detecting process finishes at step 403 in FIG. 4, CPU 21 performs a parameter communication process at step 404. The parameter communication process (step 404) will be described together with a parameter communication process to be performed in the musical instrument unit 19 (step 705 in FIG. 7).

Figure 7:
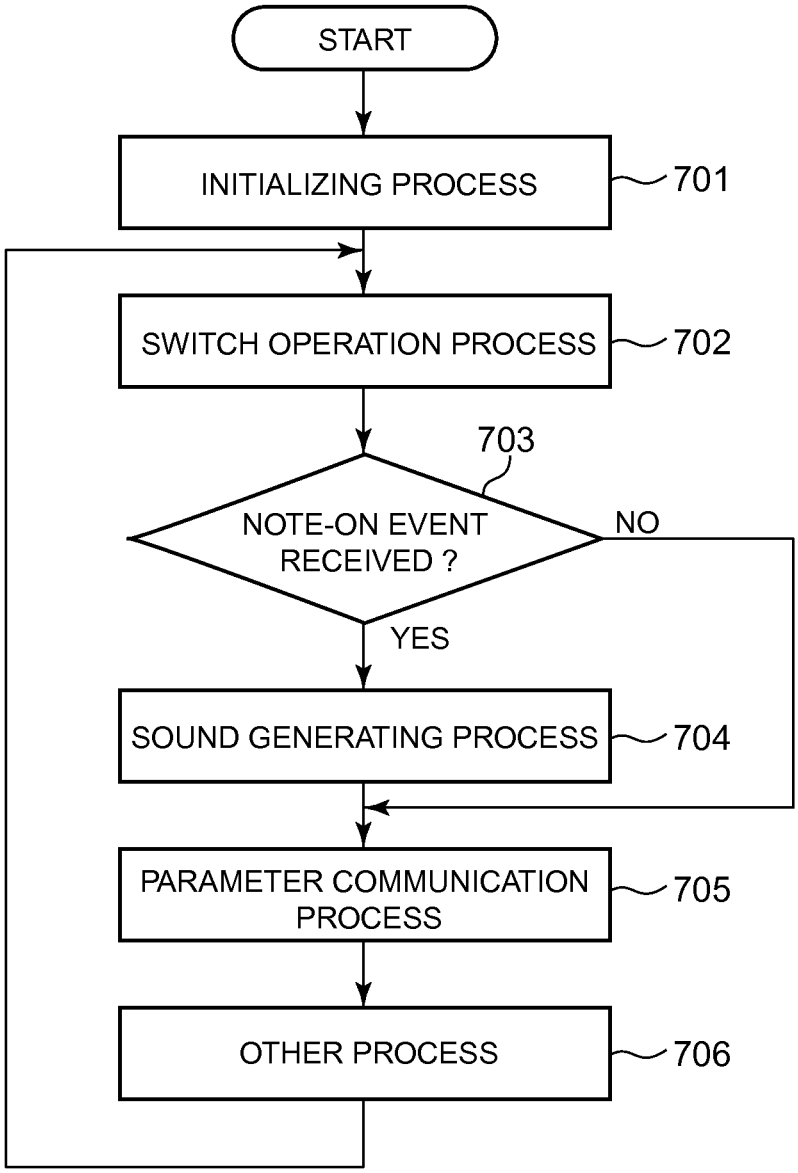
FIG. 7 is a flow chart of an example of a process performed in the musical instrument unit according to the first embodiment.

The process to be performed in the musical instrument unit 19 according to the first embodiment will be described with reference to a flow chart in FIG. 7. The flow chart of FIG. 7 shows an example of the process performed in the musical instrument unit 19 according to the first embodiment. CPU 12 of the musical instrument unit 19 performs an initializing process at step 701, thereby clearing data in RAM 15 and an image on the display screen of the displaying unit 16 and clearing the sound source 31. Then, CPU 12 performs a switch operating process at step 702. In the switch operating process, one timbre table is designated from among plural timbre tables in RAM 15 in accordance with the switch operation by the player, wherein each timbre table associates the ranges of roll angles Φ with timbres of musical tones, respectively.

Modification may be made to the present embodiment, which allows the player to edit the timbre table that associates the ranges of the roll angles Φ with timbres of musical tones, respectively. For example, CPU 21 displays the contents of the table on the display screen of the displaying unit 16, allowing the player to change the ranges of the roll angles Φ and/or the timbres of musical tones by operating the switches and ten keys in the input unit 17. The table whose contents are changed is stored in RAM 15.

Then, CPU 12 judges at step 703 whether or not any note-on event has been received through I/F 13. When it is determined at step 703 that a note-on event has been received (YES at 703), CPU 12 performs the sound generating process at step 704. In the sound generating process, CPU 12 outputs the received note-on event to the sound source unit 31. The sound source unit 31 reads waveform data from ROM 14 in accordance with the timbre represented in the note-on event. The waveform data is read at a rate corresponding to the pitch included in the note-on event. The sound source unit 31 multiplies the waveform data by a coefficient corresponding to the sound-volume data (velocity) included in the note-on event, producing musical tone data of a predetermined sound-volume level. The produced musical tone data is supplied to the audio circuit 32, and musical tones are finally output through the speaker 35.

After the sound generating process (step 704), CPU 12 performs a parameter communication process at step 705. In the parameter communication process, CPU 12 gives an instruction to the infrared communication device 33, and the infrared communication device 33 sends data of the timbre table selected in the switch operating process (step 702) to the performance apparatus 11 through I/F 13. In the performance apparatus 11, when the infrared communication device 24 receives the data, CPU 21 stores the data in RAM 26 through I/F 27 (step 404 in FIG. 4).

When the parameter communication process finishes at step 705 in FIG. 7, CPU 12 performs other process at step 706. For instance, CPU 12 updates an image on the display screen of the displaying unit 16.

In the first embodiment, a timing of generation of a musical tone is determined based on the acceleration-sensor values of the acceleration sensor 23. Rotation angles of the performance apparatus 11 about a predetermined axis (for example, the axis in the elongated direction) among the three axes of the acceleration sensor 23 are calculated based on the acceleration-sensor values obtained at a predetermined timing. CPU 21 determines based on the calculated rotation angles a musical-tone composing element (for example, a timbre) of musical tones to be generated. Therefore, it is possible to generate musical tones of the musical-tone composing element desired by the player at the timing desired by the player, using only the acceleration sensor 23.

In the first embodiment, it is determined that the operation of the performance apparatus 11 has started at the time when the acceleration-sensor value increases larger than a predetermined value, the rotation angle of the performance apparatus 11 is calculated at the timing. In other words, the player is allowed to determine the musical-tone composing element of musical tones to be generated depending on the rotation angle of the performance apparatus 11 decided at the time when he or she has started operation of the performance apparatus 11.

In the first embodiment, the rotation angle of the performance apparatus 11 about the axis in its longitudinal direction is calculated based on the acceleration-sensor values, whereby the player is allowed to change the musical-tone composing element such as a timbre of musical tones, by twisting his or her wrist as if rotating the elongated performance apparatus 11 about the axis in its longitudinal direction.

Further, in the first embodiment, the timbre as the musical-tone composing element is determined based on the calculated angle (roll angle). Therefore, the timbre of musical tones and the timing of sound generation can be determined based on the value(s) obtained by a single sensor (acceleration sensor).

In the first embodiment, in RAM 26 is stored the timbre table, which associates the ranges of rotation angles of the performance apparatus 11 and timbres of musical tones to be generated, respectively. Referring to the timbre table, CPU 21 can obtain the timbre of musical tones corresponding to the range, into which the calculated rotation angle falls, without operating a complex calculation.

Now, the second embodiment of the invention will be described. When the player swings the performance apparatus 11, then the performance apparatus 11 is rotated together with player's twisted wrist by some angles (roll angle). In the first embodiment, the roll angle Φ of the performance apparatus 11 is obtained immediately after the player has begun swinging the performance apparatus 11, but in the second embodiment, the roll angle Φ of the performance apparatus 11 is obtained immediately after the player has finished swinging the performance apparatus 11. FIG. 10 is a flow chart of an example of the sound-generation timing detecting process performed in the second embodiment. Processes at steps 1001 to 1004 in FIG. 10 are performed in substantially the same way as the processes at steps 501 to 504 in FIG. 5. In the second embodiment, when it is determined at step 1004 that the sensor-combined value is larger than the value of (1+a)G (YES at step 1004), CPU 21 sets the acceleration flag in RAM 26 to "1" at step 1005, finishing the sound-generation timing detecting process.

When it is determined at step 1003 that the acceleration flag is not set to "0" (NO at step 1003), a process at step 1006 is performed in substantially the same manner as the process at steps 507 in FIG. 5. When it is determined at step 1006 that the sensor-combined value is larger than the value of (1+a)G (NO at step 1006), processes at steps 1007 and 1008 are performed in substantially the same manner as the processes at steps 508 and 509 in FIG. 5. When it is determined at step 1006 that the sensor-combined value is less than the value of (1+a)G (YES at step 1006), CPU 21 calculates the roll angle based on the acceleration-sensor values at step 1009. The calculated roll angle is stored in RAM 26. A process at step 1009 is performed in substantially the same manner as the process at 505 in FIG. 5. Thereafter, CPU 21 performs the note-on event producing process at step 1010.

The note-on event producing process is performed in the second embodiment in substantially the same manner as the note-on event producing process performed in the first embodiment (refer to FIG. 6). In the second embodiment, the timbre of musical tones to be generated is determined based on the roll angle calculated at step 1009, that is, based on the roll angle of the performance apparatus 11 at the time when the player has finished swinging motion of the performance apparatus 11.

In the second embodiment, it is determined that movement of the performance apparatus 11 has stopped when the acceleration-sensor value decreases less than a predetermined value after once increasing large, and angles at the timing are calculated. In other words, the musical-tone composing element is determined based on the rotation angle of the performance apparatus 11 kept at the time when the player has finished swinging of the performance apparatus 11.

Now, the third embodiment of the invention will be described. In the third embodiment, a timbre of musical tones is decided based on a difference in angle (difference value) between a first roll angle and a second roll angle, wherein the first roll angle is equivalent to the rotation angle of the performance apparatus 11 which is held by the player at the time when the player has begun swinging the performance apparatus 11 and the second roll angle is equivalent to the rotation angle of the performance apparatus 11 which is held by the player at the time when the player has stopped swinging the performance apparatus 11.

FIG. 11 is a flow chart of an example of the sound-generation timing detecting process performed in the third embodiment of the invention. In FIG. 11, processes at steps 1101 to 1104 are performed in substantially the same manner as the processes at steps 501 to 504 in FIG. 5. When it is determined at step 1104 that the sensor-combined value is larger than the value of (1+a)G (YES at step 1104), CPU 21 calculates the first roll angle based on acceleration-sensor values at step 1105. The calculated roll angle is stored in RAM 26. Then, CPU 21 sets the acceleration flag in RAM 26 to "1" at step 1106.

When it is determined at step 1103 that the acceleration flag is not set to "0" (NO at step 1103), a process at step 1107 is performed in substantially the same manner as the process at steps 507 in FIG. 5. When it is determined at step 1107 that the sensor-combined value is larger than (1+a)G (NO at step 1107), processes at steps 1108 and 1109 are performed in substantially the same manner as the processes at steps 508 and 509 in FIG. 5. When it is determined at step 1107 that the sensor-combined value is less than the value of (1+a)G (YES at step 1107), CPU 21 calculates the second roll angle based on the acceleration-sensor values at step 1110. The calculated roll angle is stored in RAM 26. Thereafter, CPU 21 performs the note-on event producing process at step 1111.

FIG. 12 is a flow chart of an example of the note-on event producing process performed in the third embodiment. A process at step 1201 is performed in substantially the same manner as the process at step 601 in FIG. 6. CPU 21 calculates a difference value ΔΦ between the first roll angle and the second roll angle at step 1202. For example, the following equation is calculated:

$$\Delta\Phi = (\text{second roll angle}) - (\text{first roll angle})$$

Then, CPU 21 determines a timbre of musical tones to be generated based on the calculated difference value ΔΦ step 1203. A timbre table associates the ranges of the difference values ΔΦ with timbres of musical tones, respectively, and is stored in RAM 26 in the same manner as in the first embodiment. CPU 21 simply refers to the timbre table to determine the timbre of musical tones to be generated.

In FIG. 12, processes at steps 1204 to 1206 are performed in substantially the same manner as the processes at steps 603 to 605 in FIG. 6.

In the third embodiment, it is determined that motion of the performance apparatus 11 starts at the time when the acceleration-sensor value has increased larger than a predetermined value and the first angle of the performance apparatus 11 is calculated at the timing, and when it is determined that motion of the performance apparatus 11 stops at the time when the acceleration-sensor value has decreased less than a predetermined value after once increasing, and the second angle of the performance apparatus 11 is calculated at the timing. Then, the difference value between the first angle and the second angle is calculated. The musical-tone composing element is determined based on the calculated difference value. Therefore, in the third embodiment of the invention, the player is allowed to determine the musical-tone composing element depending on the rotation of the performance apparatus 11 about the axis in its elongated direction and a vertical displacement of the performance apparatus 11 made during a time period from the time when motion of the performance apparatus 11 starts to the time when motion of the performance apparatus 11 ends.

Now, the fourth embodiment of the invention will be described. When the player swings the performance apparatus 11, then the performance apparatus 11 is rotated together with player's twisted wrist by some angles (roll angle). In the first embodiment, the roll angle Φ of the performance apparatus 11 is obtained immediately after the player has begun swinging the performance apparatus 11, but in the fourth embodiment, a pitch angle "σ" is obtained, which is caused by an upward and downward motion of the player's wrist immediately after the player has started swinging the performance apparatus 11.

FIG. 13 is a flow chart of an example of the sound-generation timing detecting process performed in the fourth embodiment. In FIG. 13, processes at steps 1301 to 1304 are performed in substantially the same manner as the processes at steps 501 to 504 in FIG. 5, and further processes at steps 1306 to 1309 are performed in substantially the same manner as the processes at step 506 to 509 in FIG. 5. When it is determined at step 1304 that the sensor-combined value is larger than the value of (1+a)G (YES at step 1304), CPU 21 calculates a pitch angle "σ" of the performance apparatus 11 based on the acceleration-sensor values at step 1305. The calculated pitch angle "σ" of the performance apparatus 11 is stored in RAM 26. When it is determined at step 1307 that the sensor-combined value is less than the value of (1+a) G (YES at step 1307), CPU 21 performs the note-on event producing process at step 1310.

FIG. 14 is a flow chart of an example of the note-on event producing process performed in the fourth embodiment. In FIG. 14, processes at steps 1401 and 1403 to 1305 are performed in substantially the same manner as the processes at steps 601 and 603 to 605 in FIG. 6. CPU 21 determines at step 1402 a timbre of musical tones to be generated. As in the first embodiment, the timbre table, which associates the ranges of the pitch angles "σ" with timbres of musical tones, respectively is stored in RAM 26 in the fourth embodiment. Referring to the timbre table, CPU 21 can obtain the timbre of musical tones by finding the range, into which the pitch angle "σ" falls.

In the fourth embodiment, the pitch angle "σ" of the performance apparatus 11 is calculated based on the acceleration-sensor values, which angle is caused when the performance apparatus 11 is turned about the axis perpendicular to the axis in the longitudinal direction of the performance apparatus 11, whereby the player is allowed to change the musical-tone composing elements such as a timbre depending on his or her wrist motion in the upward and downward direction.

The present invention has been described with reference to the accompanying drawings and the first to the fourth embodiment, but it will be understood that the invention is not limited to these particular embodiments described herein, and numerous arrangements, modifications, and substitutions may be made to the embodiments of the invention described herein without departing from the scope of the invention.

For instance, in the forth embodiment, a timbre of musical tones to be generated, in particular, a name of a natural instrument is changed based on the roll angle, pitch angle and/or difference value. But the invention is not limited to the above, and an arrangement may be made such that other musical-tone composing elements are changed based on the roll angle, pitch angle and/or difference value. For instance, a modification may be made, that as musical-tone composing elements other than the timbre, plural separate acoustic effects such as reverberation times, vibrato lengths and strengths, are previously prepared for musical tones of the natural instruments (for example, piano), and either one of such acoustic effects is selected based on the roll angle, pitch angle and/or difference value.

In the embodiments, CPU 21 of the performance apparatus 11 detects acceleration-sensor values caused when the player swings the performance apparatus 11, determining the timing of sound generation. Further, CPU 21 of the performance apparatus 11 detects the roll angle or the pitch angle of the performance apparatus 11 at a predetermined timing (for example, at a time immediately after the player swings the performance apparatus 11), determining a timbre of musical tones to be generated based on the detected roll angle or pitch angle. Thereafter, CPU 21 of the performance apparatus 11 produces a note-on event including a sound-volume level and timbre at the timing of sound generation, and transmits the note-on event to the musical instrument unit 19 through I/F 27 and the infrared communication device 24. Meanwhile, in the musical instrument unit 19, receiving the note-on event, CPU 12 supplies the received note-on event to the sound source unit 31, thereby generating a musical tone. The above arrangement is preferably used in the case that the musical instrument unit 19 is a device not specialized in generating musical tones, such as personal computers and game machines provided with a MIDI board.

The processes to be performed in the performance apparatus 11 and the processes to be performed in the musical instrument unit 19 are not limited to those described herein in the embodiments. For example, a rearrangement may be made to the performance apparatus 11, that obtains the acceleration sensor values, roll angle and pitch angle, and sends them to the musical instrument unit 19. In the rearrangement, the sound generation timing detecting process (FIG. 5) and the note-on event producing process (FIG. 6) are performed in the musical instrument unit 19. The rearrangement is suitable for use in electronic musical instruments, in which the musical instrument unit 19 is used as a device specialized in generating musical tones.

Further, in the embodiments, the infrared communication devices 24 and 33 are used to exchange an infrared signal of data between the performance apparatus 11 and the musical instrument unit 19, but the invention is not limited to the exchange of infrared signals. For example, a modification may be made such that wireless communication and/or wire communication is used in place of the infrared communication devices 24 and 33 to exchange data between the performance apparatus 110 and the musical instrument unit 19.

In the embodiments, the sound-volume level of a musical tone to be generated is determined based on the sensor-combined value of the acceleration sensor, but the sound-volume level may be constant.

In the fourth embodiment, a pitch angle "σ" of the performance apparatus 11 is obtained, which angle is caused by upward and downward motion of the player's wrist immediately after he or she has started swinging the performance apparatus 11. The invention is not limited to the above pitch angle "σ", but a pitch angle caused at the following timing or a difference in pitch angles can be used to determine a timbre of musical tones.

Relationship between modification to the fourth embodiment and the fourth embodiment is substantially the same as relationship between the second embodiment and the first embodiment. In other words, in the modification, a pitch angle "σ" of the performance apparatus 11 is obtained, which angle is caused by upward and downward motion of the player's wrist immediately after he or she has stopped swinging the performance apparatus 11, and a timbre of musical tones is decided based on the obtained pitch angle "σ". In the sound-generation timing detecting process to be performed in the modification, CPU 21 calculates a pitch angle "σ" in place of the roll angle at step 1009 in FIG. 10.

Relationship between other modification to the fourth embodiment and the fourth embodiment is substantially the same as relationship between the third embodiment and the first embodiment. In other words, in other modification, a difference value between a first pitch angle and a second pitch angle is obtained and a timbre of musical tones is determined based on the obtained difference value, wherein the first pitch angle is an angle of the performance apparatus 11 caused immediately after the player has started swinging the performance apparatus 11 and the second pitch angle is an angle of the performance apparatus 11 caused at the time when the player has stopped swinging the performance apparatus 11. In the sound-generation timing detecting process to be performed in other modification, CPU 21 calculates the first pitch angle based on the acceleration-sensor values at step 1105 in FIG. 11. Further, CPU 21 calculates the second pitch angle based on the acceleration-sensor values at step 1110 in FIG. 11. In the note-on event producing process to be performed in other modification, CPU 21 calculates the difference value Δσ between the first pitch angle and the second pitch angle at step 1202 in FIG. 12, determining a timbre of musical tones based on the calculated difference value Δσ at step 1203.

What is claimed is:

1. A performance apparatus to be used with a musical-tone generating device for generating musical tones, the performance apparatus comprising:

a holding member extending in a longitudinal direction to be held by a player with his or her hand;

an acceleration sensor provided in the holding member, for obtaining acceleration-sensor values along three axial directions; and controlling means for giving the musical-tone generating device an instruction of generating a musical tone, wherein the controlling means comprises:

sound-generation instructing means for giving the musical-tone generating device an instruction of generating a musical tone at a timing specified based on the acceleration-sensor values obtained by the acceleration sensor;

angle calculating means for calculating, based on acceleration-sensor values obtained by the acceleration sensor at a certain timing when a value obtained based on the acceleration-sensor values obtained at the certain timing has increased to larger than a predetermined value, a roll angle of the holding member rotating about an axis in the longitudinal direction of the holding member; and musical-tone composing element deciding means for deciding a musical-tone composing element of a musical tone to be generated, based on the roll angle calculated by the angle calculating means.

2. The performance apparatus according to claim 1, wherein the musical-tone composing element deciding means decides a timbre of a musical tone to be generated, based on the roll angle calculated by the angle calculating means.

3. The performance apparatus according to claim 2, further comprising:

storing means for storing a timbre table, which associates ranges of roll angles with timbres of musical tones to be generated, wherein the musical-tone composing element deciding means refers to the timbre table stored in the storing means to decide a timbre of a musical tone to be generated.

4. The performance apparatus according to claim 1, wherein the value obtained based on the acceleration-sensor values obtained by the acceleration sensor is a sensor-combined value which is calculated from the obtained acceleration sensor values.

5. A performance apparatus to be used with a musical-tone generating device for generating musical tones, the performance apparatus comprising:

a holding member extending in a longitudinal direction to be held by a player with his or her hand;

an acceleration sensor provided in the holding member, for obtaining acceleration-sensor values along three axial directions; and controlling means for giving the musical-tone generating device an instruction of generating a musical tone, wherein the controlling means comprises:

sound-generation instructing means for giving the musical-tone generating device an instruction of generating a musical tone at a timing specified based on the acceleration-sensor values obtained by the acceleration sensor;

the angle calculating means for calculating, based on acceleration-sensor values obtained by the acceleration sensor at a certain timing when a value obtained based on the acceleration-sensor values obtained at the certain timing has decreased to less than a predetermined value after increasing once, a roll angle of the holding member rotating about an axis in the longitudinal direction of the holding member; and musical-tone composing element deciding means for deciding a musical-tone composing element of a musical tone to be generated, based on the roll angle calculated by the angle calculating means.

6. The performance apparatus according to claim 5, wherein the musical-tone composing element deciding means decides a timbre of a musical tone to be generated, based on the roll angle calculated by the angle calculating means.

7. The performance apparatus according to claim 6, further comprising:

storing means for storing a timbre table, which associates ranges of roll angles with timbres of musical tones to be generated, wherein the musical-tone composing element deciding means refers to the timbre table stored in the storing means to decide a timbre of a musical tone to be generated.

8. The performance apparatus according to claim 5, wherein the value obtained based on the acceleration-sensor values obtained by the acceleration sensor is a sensor-combined value which is calculated from the obtained acceleration sensor values.

9. A performance apparatus to be used with a musical-tone generating device for generating musical tones, the performance apparatus comprising:

a holding member extending in a longitudinal direction to be held by a player with his or her hand;

an acceleration sensor provided in the holding member, for obtaining acceleration-sensor values along three axial directions; and controlling means for giving the musical-tone generating device an instruction of generating a musical tone, wherein the controlling means comprises:

sound-generation instructing means for giving the musical-tone generating device an instruction of generating a musical tone at a timing specified based on the acceleration-sensor values obtained by the acceleration sensor;

angle calculating means for (i) calculating, based on acceleration-sensor values obtained by the acceleration sensor at a first timing when a value obtained based on the acceleration-sensor values obtained at the first timing has increased to larger than a predetermined value, a first roll angle of the holding member rotating about an axis in the longitudinal direction of the holding member, (ii) calculating, based on acceleration-sensor values obtained by the acceleration sensor at a second timing when a value obtained based on the acceleration-sensor values obtained at the second timing has decreased to less than a predetermined value after increasing once, a second roll angle of the holding member rotating about the axis in the longitudinal direction of the holding member, and (iii) calculating a difference value between the first roll angle and the second roll angle of the holding member; and musical-tone composing element deciding means for deciding a musical-tone composing element of a musical tone to be generated, based on the difference value calculated by the angle calculating means.

10. The performance apparatus according to claim 9, wherein the musical-tone composing element deciding means decides a timbre of a musical tone to be generated, based on the difference value calculated by the angle calculating means.

11. The performance apparatus according to claim 10, further comprising:

storing means for storing a timbre table, which associates ranges of difference values with timbres of musical tones to be generated, wherein the musical-tone composing element deciding means refers to the timbre table stored in the storing means to decide a timbre of a musical tone to be generated.

12. The performance apparatus according to claim 9, wherein the values obtained based on the acceleration-sensor values obtained by the acceleration sensor are sensor-combined values which are calculated from the obtained acceleration sensor values.

13. An electronic musical instrument comprising:

a musical instrument unit having a musical-tone generating device for generating musical tones; and a performance apparatus having a holding member extending in a longitudinal direction to be held by a player with his or her hand;

an acceleration sensor provided in the holding member for obtaining acceleration-sensor values along three axial directions; and controlling means for giving the musical-tone generating device an instruction of generating a musical tone, wherein the controlling means comprises:

sound-generation instructing means for giving the musical-tone generating device an instruction of generating a musical tone at a timing specified based on the acceleration-sensor values obtained by the acceleration sensor;

angle calculating means for calculating, based on acceleration-sensor values obtained by the acceleration sensor at a certain timing when a value obtained based on the acceleration-sensor values obtained at the certain timing has increased to larger than a predetermined value, a roll angle of the holding member rotating about an axis in the longitudinal direction of the holding member; and musical-tone composing element deciding means for deciding a musical-tone composing element of a musical tone to be generated, based on the roll angle calculated by the angle calculating means, wherein both the musical instrument unit and the performance apparatus comprise communication means for exchanging data with each other.

14. The performance apparatus according to claim 13, wherein the value obtained based on the acceleration-sensor values obtained by the acceleration sensor is a sensor-combined value which is calculated from the obtained acceleration sensor values.

* * * * *